US010166770B2

(12) United States Patent
Chung et al.

(10) Patent No.: US 10,166,770 B2
(45) Date of Patent: Jan. 1, 2019

(54) ADDRESSING PIGMENT SETTLING DEFECTS IN TIJ BY USING NATURAL CONVECTION TO STIR THE INK

(71) Applicant: HEWLETT-PACKARD DEVELOPMENT COMPANY, L.P., Houston, TX (US)

(72) Inventors: Bradley D. Chung, Corvallis, OR (US); R. William Grobman, Vancouver, WA (US); Daniel B. Brown, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/558,440

(22) PCT Filed: Jul. 31, 2015

(86) PCT No.: PCT/US2015/043113

§ 371 (c)(1),
(2) Date: Sep. 14, 2017

(87) PCT Pub. No.: WO2017/023246

PCT Pub. Date: Feb. 9, 2017

(65) Prior Publication Data

US 2018/0065362 A1 Mar. 8, 2018

(51) Int. Cl.
*B41J 2/14* (2006.01)

(52) U.S. Cl.
CPC ..... *B41J 2/1408* (2013.01); *B41J 2/14145* (2013.01)

(58) Field of Classification Search
CPC ..... B41J 2/211; B41J 2/1408; B41J 2/14145
USPC ..... 347/20
See application file for complete search history.

(56) References Cited

U.S. PATENT DOCUMENTS

| | | | | |
|---|---|---|---|---|
| 4,814,786 | A * | 3/1989 | Hoisington | B41J 2/17593 347/88 |
| 5,993,053 | A | 11/1999 | Clark | |
| 6,074,043 | A | 6/2000 | Ahn | |
| 6,234,599 | B1 * | 5/2001 | Ishinaga | B41J 2/0451 347/14 |
| 6,343,857 | B1 | 2/2002 | Cowger | |
| 8,430,486 | B2 | 4/2013 | Serizawa et al. | |
| 8,651,646 | B2 | 2/2014 | Govyadinov et al. | |
| 2002/0012035 | A1 * | 1/2002 | Mouri | C09D 11/324 347/100 |
| 2002/0051039 | A1 * | 5/2002 | Moynihan | A01K 15/025 347/68 |
| 2003/0016263 | A1 * | 1/2003 | Takahashi | B41J 2/125 347/19 |

(Continued)

FOREIGN PATENT DOCUMENTS

EP 1516736 3/2005

OTHER PUBLICATIONS http://sdgmag.com/articie/printing-finishing/think-ink-white-inkjet-ink Title: Think Ink: White Inkjet Ink Author: Work, R.

*Primary Examiner* — Huan Tran
*Assistant Examiner* — Alexander D Shenderov
(74) *Attorney, Agent, or Firm* — HP Inc. Patent Development

(57) ABSTRACT

A heating device along a slot of a print head is selectively actuated to form temperature gradients within fluid along the slot to facilitate convective fluid flow within and along the slot.

20 Claims, 5 Drawing Sheets

(56) References Cited

U.S. PATENT DOCUMENTS

| | | | |
|---|---|---|---|
| 2004/0085417 | A1 | 5/2004 | Childs et al. |
| 2010/0079559 | A1 | 4/2010 | Justice et al. |
| 2012/0007921 | A1 | 1/2012 | Govyadinov et al. |

* cited by examiner

ADDRESSING PIGMENT SETTLING DEFECTS IN TIJ BY USING NATURAL CONVECTION TO STIR THE INK

BACKGROUND

Print heads are used to eject droplets of fluid. Such print heads sometimes employ a slot to supply fluid to drop ejection devices along the slot.

DETAILED DESCRIPTION OF EXAMPLES

Figure 1:
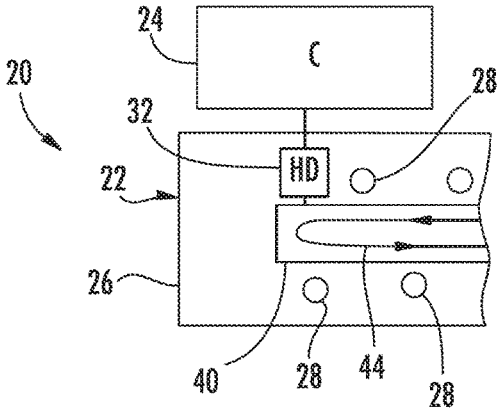
FIG. 1 is a schematic diagram of an example printing system.

FIG. 1 is a schematic diagram illustrating a portion of an example printing system 20. Printing system 20 selectively ejects droplets of fluid, such as ink, onto a substrate or medium using a series of drop ejection devices located along a slot which supplies the drop ejection devices with the fluid. Over time, concentration gradients form within the fluid contained within the slot. Such concentration gradients may impair the performance of the printing system. As will be described hereafter, printing system 20 selectively heats the fluid within and along the slot to create temperature gradients which promote convection flow within and along the slot to stir or mix the fluid and reduce the concentration gradients.

Printing system 20 comprises print head 22 and controller 24. Print head 22 comprises device by which fluid, such as pigment ink, is selectively deposited upon a substrate or print medium, drop by drop, upon the substrate or print medium. In one implementation, print head 22 selectively ejects drops of fluid to form an image or pattern upon a print medium or substrate. In another implementation, print head 22 selectively ejects drops of fluid in a controlled manner for other purposes and onto other types of substrates. For example, in other implementations, print head 22 may selectively eject droplets of fluid in manufacturing applications or in testing or analytical applications, such as testing in industrial or medical applications. In one implementation, print head 22 spans are extends across a width of the print medium such as with a page wide array print head. In another implementation, print head 22 is supported by a movable carriage that carries print head 22 across the print medium during printing.

Print head 22 comprises print head body 26, nozzles 28 and heating device 32. Print head body 26, sometimes referred to as a print head die or sliver, comprises a structure in which is formed an elongate slot 40. Slot 40 comprises an elongate channel that is connected to a fluid source to receive fluid from the fluid source. In one implementation, the fluid source comprises an onboard fluid source proximate slot 40. In another implementation, the fluid source comprises an off-axis fluid source. Slot 40 delivers the fluid received from the fluid source to drop ejection devices that selectively eject droplets of fluid are ink through nozzles 28 which are situated along slot 40. Although print head 22 is illustrated as comprising a single print head body 26, in other implementations, print head 22 may comprise multiple print head bodies 26.

Heating device 32 (schematically shown) comprises a device or multiple devices by which fluid along selected portions of slot 40 are selectively heated to create temperature gradients within and along the fluid within slot 40. In one implementation, heating device 32 comprises the drop ejection devices themselves. For example, in one implementation, the drop ejection devices comprise thermal fluid droplet ejection resistors located in firing chambers, each firing chamber being proximate to an assigned or associated nozzle 28. During printing or other fluid ejection, pulses of electrical current are supplied to such resistors so as to very briefly heat the adjacent fluid within the firing chamber within energy level above the apparent nucleation threshold (ANT) energy so as to vaporize the adjacent fluid, creating a vapor bubble which expels surrounding fluid, such as a droplet, through the associated nozzle 28. In implementations where the fluid comprises ink, largely composed of water, the thermal fluid droplet ejection resister heats the adjacent fluid within the firing chamber to a temperature above the critical temperature of water, approximately 300° C., depending upon various other factors such as pressure and the like.

When used as heating device 32 to facilitate convective fluid flow within slot 40, the thermal fluid droplet ejection resistors do not vaporize the adjacent fluid within the firing chamber and do not create or form bubbles. When used as heating device 32, the thermal fluid droplet ejection resistors are supplied with pulses of electric current which heat the adjacent fluid within the firing chamber to a maximum temperature less than the ANT temperature, and in the case of water-based fluids or inks, less than the critical temperature of water. The heated water within the firing chamber rises and moves into the slot 40 where convective fluid flow is promoted.

In other implementations, heating device 32 comprises portions of the drop ejection devices modified to facilitate heating of the fluid along the slot 40. In one implementation, heating device 32 comprises the transistor associated with the drop ejection device. In still other implementations, heating device 32 comprises a heating element or heating component distinct from the drop ejection devices, dedicated to heating fluid within slot 40. In implementations where heating device 32 comprises a component other than a thermal fluid droplet ejection resistor, the drop ejection device may comprise a drop ejection device other than a thermal fluid droplet ejection drop ejection device. For example, where heating device 32 comprises the transistor of a drop ejection device or where heating device 32 comprises an independent heating element or heating component, the drop ejection device may comprise piezo-resistive drop ejection device where a diaphragm is moved to force fluid through an associate one of nozzles 28.

In one implementation, heating device 32 is carried by print head body 26 and is formed as part of print head body 26. In other implementations, such as where print head 22 is carried by a carriage, heating device 32 may be located at a docking station or service station alongside the path of the print media. For example, when the print head 22 is not printing, print head 22 may be moved to a docking station or serving station alongside the path of the print media. When docked, the printing bodies 26 of print head 22 are located proximate to heating devices 32 at the docking or service station, wherein the docking or service station heating devices 32 are controlled to selectively heat portions of the fluid within slot 40 to create temperature gradients across the fluid within slot 40 to facilitate convective flow and the stirring or mixing of the fluid within the slot 40 of each of the printing bodies 26.

Controller 24 comprises electronics or electronic circuitry that controls the timing and the mixing or stirring of fluid within slot 40 using heating device 32. In one implementation, controller 24 comprises an integrated circuit chip formed upon or integrated as part of print head body 26. In other implementations, controller 24 is remote from print head body 26, communicating with heating device 32. In one implementation, controller 24 comprises a processing unit that controls the timing and the mixing or stirring of fluid within slot 40 using heating device 32.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 24 may be embodied as part of one or more application-specific integrated circuits (ASICs). Unless otherwise specifically noted, the controller is not limited to any specific combination of hardware circuitry and software, nor to any particular source for the instructions executed by the processing unit.

In one implementation, controller 24 actuates heating device 32 to create temperature gradients of at least 0.1deg C./mm for periods of time of at least 1 sec. In one implementation, heating device 32 is actuated by controller 24 so as to provide sufficient heat or energy such that such temperature gradients extend along at least 1 mm of slot 40. In one implementation, heating device 32 is actuated by controller 24 so as to produce such pride sufficient heat or energy such that temperature gradients extend upward (perpendicular to the major dimension or longitudinal length of slot 40) beyond slot 40 and into the plenum or are fluid supply channel that supplies fluid to slot 40. In one implementation, such temperature gradients facilitate convective fluid flow beyond and upwards of slot 40, further into the fluid feed system that supplies fluid to slot 40. In one implementation, such temperature gradients facilitate convective fluid flow at least 1 mm above a top of slot 40 and nominally at least 2 mm above a top of slot 40. In one implementation, such temperature gradients produce or facilitate convection velocities of the fluid within slot 40 and upwards beyond slot 40 of at least 0.05 mm/sec.

FIG. 1 schematically illustrates an example of such convective flow 44 initiated by controller 24. Although flow 44 is illustrated with arrows extending in the plane of the paper, actual flow may additionally extends into and out of the paper, 90° from the direction illustrated in the Figures. The convective flow of the fluid within slot 40 stirs or mixes the fluid within slot 40 to reduce concentration gradients. For example, in one implementation, printing system 20 print using a pigment-based ink. Such pigment-based inks contain pigments are particles which sometimes settle to create concentration gradients, abrupt changes in levels of concentration. The convective flow created by system 20 stirrers or mixes the pigment-based ink to level out or unify the concentration levels of such pigment particles along slot 40 as well as upwards and beyond slot 40. As a result, printing performance may be improved.

In one implementation, under the control of controller 24, heating device 32 applies a warming cycle comprising the application of 0.8 W of power for one second followed by a wait at zero power of 1.4 seconds. The cycle is repeated continually. The resulting temperature gradients result in a gradual development of natural convection currents taking on the order of 24 seconds to fully develop. Although the maximum temperature the fluid within slot 40 remains below 70° C., convention velocities on the order of 2 mm/s may be achieved.

In one implementation, controller 24 actuates heating device 32 to initiate mixing or stirring of fluid within slot 40 in response to a command inputted by a person. For example, in response to the selection or clicking upon of an icon or the depression of a button, controller 24 may initiate such stirring. In another implementation, controller 24 actuates heating device 32 to initiate mixing or stirring of fluid within slot 40 based upon a predetermined lapse of time since (A) the last stirring of fluid within slot 40 and/or (B) the last time that printing was carried out by printing system 20. In such an implementation, controller 24 may track or keep record of prior mixing/stirring occurrences and/or prior printing occurrences. In yet another implementation, controller 24 actuates heating device 32 based upon a sensed characteristic of the fluid within slot 40 such as a sensed degree of settling or concentration gradients within slot 40.

In one implementation, controller 24 varies the degree to which the fluid within slot 40 is mixed or stirred. For example, in one implementation controller 24 may stir the fluid within slot 40 for different durations of time or may create different degrees of temperature gradients based upon inputs or commands or person, the amount of lapsed time since the last stirring occurrence or printing occurrence, and/or the sensed degree of settling or concentration gradients within slot 40. The degree to which controller 24 varies the duration or intensity of stirring may also vary based upon a determined intensity of the prior printing occurrence depositing fluid from the particular slot 40.

Figure 2:
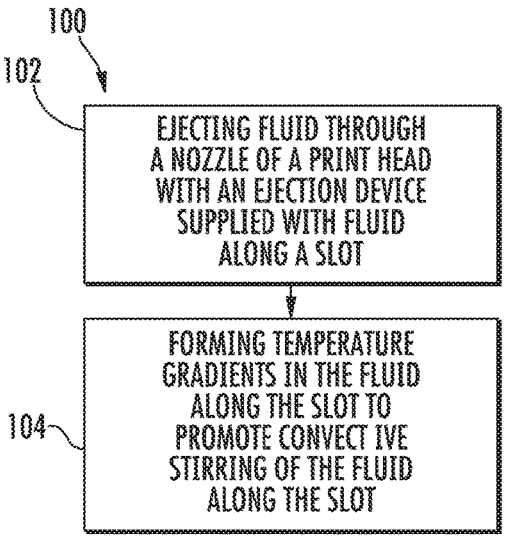
FIG. 2 is a flow diagram of an example method for printing and mixing fluids.

FIG. 2 is a flow diagram illustrating an example method 100 that may be carried out by printing system 20 described above. As indicated by block 102, during printing operations, printing system 20 ejects fluid, such as zinc or pigment-based ink, through a nozzle 28 of print head body 26 with an ejection device that is supplied with the fluid along slot 40.

As indicated by block 104, controller 24 forms temperature gradients in the fluid along slot 42 promote convective stirring of the fluid along the slot 40 an upwardly beyond slot 40, stirring fluid within the fluid passages that supply fluid to slot 40. In one example stirring operation, fluid at a first location along slot 40 may be at a first higher temperature while fluid at a second location along slot 40 may be at a second lower temperature. These temperature differences within the fluid along slot 40 an upwardly beyond slot 40, temperature gradients, promote convective flow. The warmer fluid at the first location tends to rise and move along slot 40 while the cooler fluid replaces the volume previously occupied by the warmer fluid.

Figure 3:
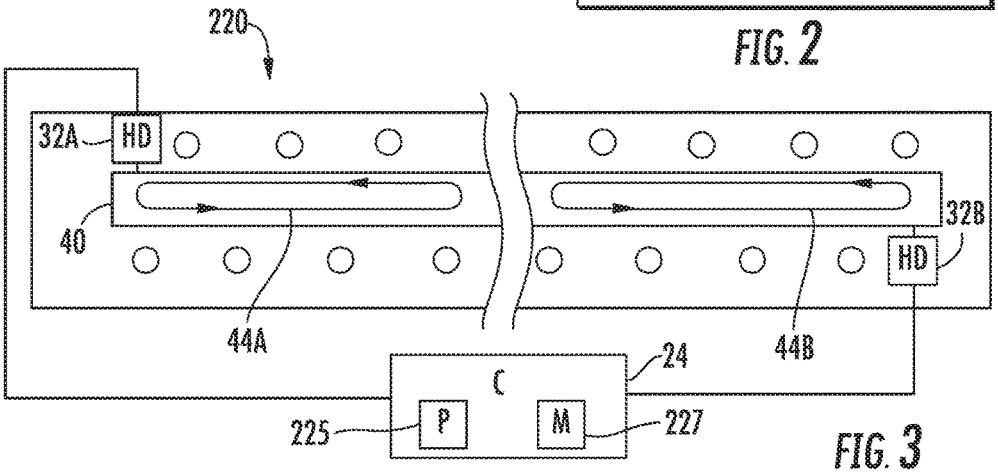
FIG. 3 is a schematic diagram of another example printing system.

FIG. 3 schematically illustrates printing system 220, an example implementation of printing system 20 described above. Printing system 220 is similar to printing system 20 except that printing system 220 is specifically illustrated as comprising two independently actuatable heating devices 32A, 32B, one heating device 32 at each of the opposite end portions of slot 40. In the example illustrated, heating device 32A, 32B are situated on opposite sides of slot 40 as well. Those remaining components are elements of printing system 220 which correspond to components or elements of system 20 are numbered similarly.

As schematically shown by FIG. 3, controller 24, which is illustrated as comprising a processing unit 225 and an associated memory 227, outputs control signals which causes the two heating devices 32A, 32B at opposite ends of slot 40 to heat the fluid within slot 40 with a maximum amount of energy below the ANT energy of the fluid and to a temperature below the critical temperature of water, so as to form capture gradients within the fluid. As further shown by FIG. 3, such temperature gradients create or promote convective fluid flows 44A, 44B to stir mix the fluid within slot 40. In one implementation, such temperature gradients comprise gradients of at least 0.1deg C./mm for periods of time of at least 1 sec. In one implementation, heating device 32 provide sufficient heat or energy such that such heating gradients extend along at least 1 mm of slot 40. In one implementation, such temperature gradients produce or facilitate convection velocities of the fluid within slot 40 of at least 0.05 mm/s.

Figure 4:
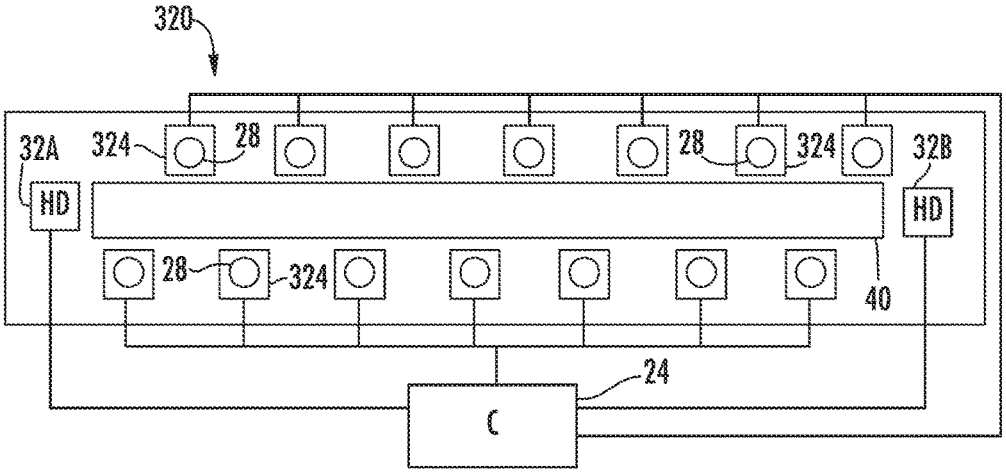
FIG. 4 is a schematic diagram of another example printing system.

FIG. 4 schematically illustrates printing system 320, another example implementation of printing system 20. Printing system 320 is similar to printing system 220 except that heating devices 32A, 32B are specifically illustrated as being provided independently of drop ejection devices 324 (schematically illustrated) for each of the associated nozzles 28. In the example illustrated, heating devices 32A, 32B are situated at opposite ends of slot 40. In one implementation, drop ejection devices 324 comprises piezoresistive drop injectors. In another implementation, drop ejection devices 324 comprise thermal fluid droplet ejection resistors. In implementations where drop ejection devices 324 comprises thermal fluid droplet ejection resistors, controller 24 may utilize selected ones of thermal fluid droplet ejection resistors 324 as additional or supplemental heating devices, wherein controller 24 outputs control signals causing such thermal fluid droplet ejection resistors to heat the fluid within slot 40 with energy levels below ANT energy levels of the fluid within slot 40 such that the temperature of the fluid does not rise above a temperature which bubbles will begin to form within the fluid.

In one implementation, system 320 produces temperature gradients within the fluid within slot 40 of at least 0.1deg C./mm for periods of time of at least 1 sec. In one implementation, heating devices 32A, 32B provide sufficient heat or energy such that such heating gradients extend along at least 1 mm of slot 40. In one implementation, such temperature gradients produce or facilitate convection velocities of the fluid within slot 40 of at least 0.05 mm/s.

Figure 5:
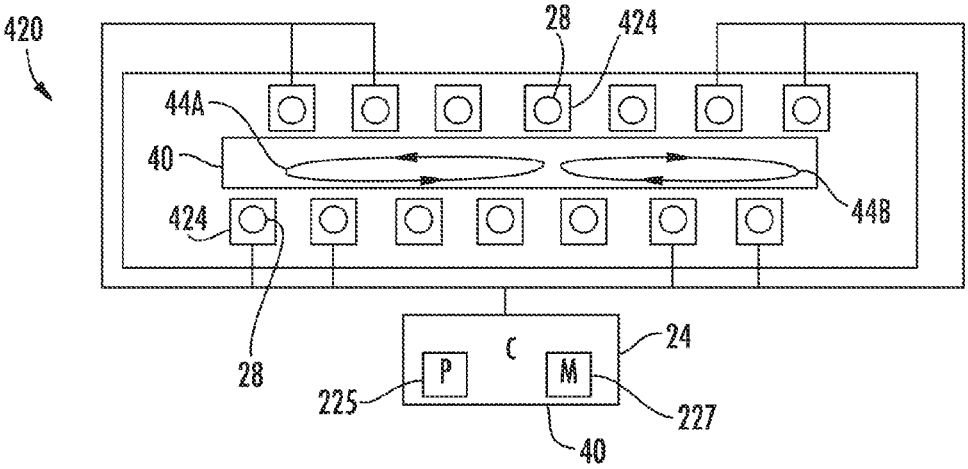
FIG. 5 is a schematic diagram of another example printing system.

FIG. 5 schematically illustrates printing system 420, another example implementation of printing system 20 described above. Printing system 420 is similar to printing system 220 except that printing system 420 is specifically illustrated as employing thermal fluid droplet ejection resistors 424 to heat fluid within selected portions of slot 40 so as to promote convective flow 44A, 44B of such fluid within slot 40 for mixing or stirring. In such an implementation, the thermal fluid droplet ejection resistors 424 are dual purposed: used to eject drops of ink during printing at times and to create temperature gradients to promote convective stirring at other times. In the example illustrated, controller 24 is communicatively connected to those thermal fluid droplet ejection resistors 424 proximate opposite end portions of slot 40, wherein such thermal fluid droplet ejection resistors 424 may be selectively actuated to create temperature gradients and promote convective stirring. Although FIG. 5 illustrates four pairs of thermal fluid droplet ejection resistors being actuated on opposite sides and proximate opposite ends of slot 40 to promote such convective stirring, in other implementations, additional or greater number of such thermal fluid droplet ejection resistors may be selectively actuated by controller 24 to create temperature gradients and promote convective stirring. In one implementation, controller 24 also controls all of the thermal fluid droplet ejection resistors 424 during printing. In yet another implementation, system 420 comprises a separate controller that controls thermal fluid droplet ejection resistors 424 during printing.

In one implementation, system 420 produces temperature gradients within the fluid within slot 40 of at least 0.1deg C./mm for periods of time of at least 1 sec. In one implementation, heating devices 32A, 32B provide sufficient heat or energy such that such heating gradients extend along at least 1 mm of slot 40. In one implementation, heating device 32 is actuated by controller 24 such pride sufficient heat or energy such that temperature gradients extend upward (perpendicular to the major dimension or longitudinal length of slot 40) beyond slot 40 and into the plenum are fluid supply channel that supplies fluid to slot 40. In one implementation, such temperature gradients facilitate convective fluid flow beyond and upwards of slot 40, further into the fluid feed system that supplies fluid to slot 40. In one implementation, such temperature gradients facilitate convective fluid flow at least 1 mm above a top of slot 40 and nominally at least 2 mm above a top of slot 40. In one implementation, such temperature gradients produce or facilitate convection velocities of the fluid within slot 40 of at least 0.05 mm/s.

Figure 6:
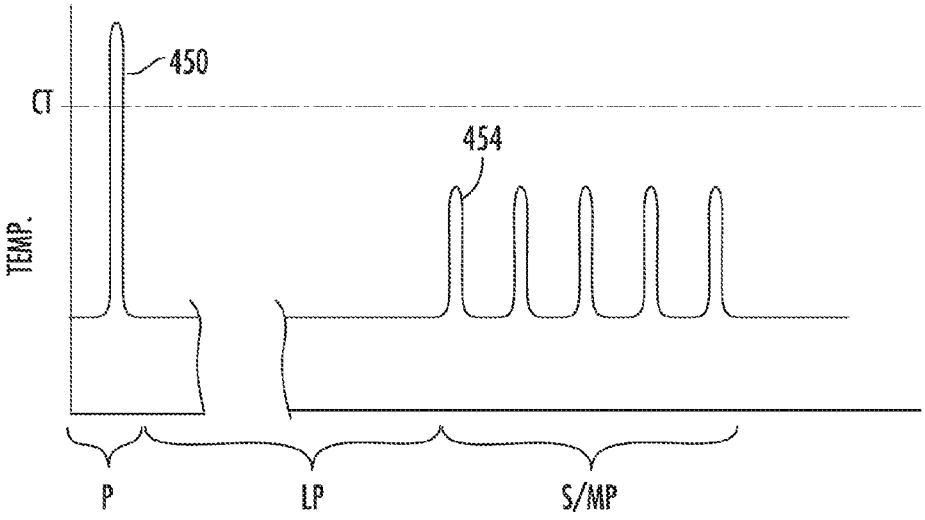
FIG. 6 is a time-temperature graph illustrating one example operation of the printing system of FIG. 5.

FIG. 6 is a time temperature graph illustrating one example operation of system 420 described above, wherein the drop ejection devices comprise thermal fluid droplet ejection resistors. As shown by FIG. 6, during printing P, for each droplet of ink ejected, the thermal fluid droplet ejection resistors are actuated or fired by transmitting sufficient electric current through the thermal fluid droplet ejection resistors for a single firing or pulse 450 so as to heat the adjacent fluid within the adjacent firing chamber to a temperature above the critical temperature of the fluid or the critical temperature of the main solvent of the fluid, such as water (the critical temperature of water being approximately 300° C.). This results in nucleation of the fluid to form an expanding bubble that forcefully eject fluid through an adjacent nozzle.

As shown by FIG. 6, following such printing, the print head may undergo a lapse period LP during which the print head or nozzles supplied with fluid from of particular slot are not utilized. As noted above, in some implementations, controller 24 tracks the time since the last printing and automatically initiates stirring or mixing upon the track lapse time satisfying a predefined threshold of time. In other implementations, such stirring or mixing is it initiated in response to user input. In other implementations, such stirring or mixing is automatically initiated by controller 40 in response to a sensed characteristic of the fluid within slot 40, such as a sensed parameter pertaining to particle or pigment concentration gradients. In yet other implementations, stirring or mixing is automatically initiated at predefined time periods or time intervals, regardless of when the last printing occurred.

During an initiated stirring or mixing time period, S/MP, the heating the thermal fluid droplet ejection resistors 424 are actuated to heat fluid within slot 40 so as to create temperature gradients sufficient to cause convective stirring or mixing so as to reduce concentration gradients of the fluid within slot 40 as well as concentration gradients upwardly beyond slot 40. As graphically shown by FIG. 6, controller 40 outputs control signals causing each of the thermal fluid droplet ejection resistors to be actuated or pulsed multiple times over a prolonged period of time are cycles, wherein in each individual pulse heats the adjacent fluid to a maximum temperature that is less than the critical temperature for the fluid such that the fluid is not nucleated and no bubbles are formed. The number of pulses during the stirring or mixing time period is sufficient to heat the temperature of the adjacent fluid to form the temperature gradients that cause convective stirring or mixing. In one implementation, each individual pulse 454 during the stirring or mixing time period heats the adjacent fluid such that the adjacent fluid is at a temperature above 100° C. (and less than the critical temperature of the fluid) for a duration on the order of tens of microseconds such that the overall average temperature of the adjacent fluid during the stirring or mixing time period does not exceed an average elevated temperature of 80° C. This average elevated temperature 80° C. is sufficiently higher than the temperature of the fluid within slot 40 long other portions of slot 40 such a temperature gradients result in stirring or mixing to reduce concentration gradients in the fluid within slot 40. In implementations where degassed fluid is supplied through slot 40, each individual pulse 454 during the stirring or mixing time period heats the adjacent fluid such that the adjacent fluid is at a temperature above 100° C. (and less than the critical temperature of the fluid) for a duration on the order of tens of microseconds during the stirring or mixing time period heats the adjacent fluid such that the overall average temperature of the adjacent fluid during the stirring or mixing time period is not exceed an average elevated temperature of 99° C.

Figure 7:
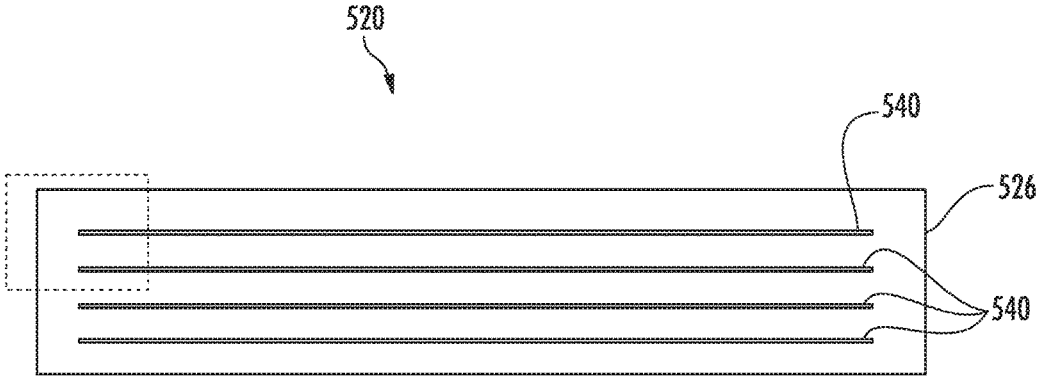
FIG. 7 is a schematic diagram of another example printing system.
Figure 8:
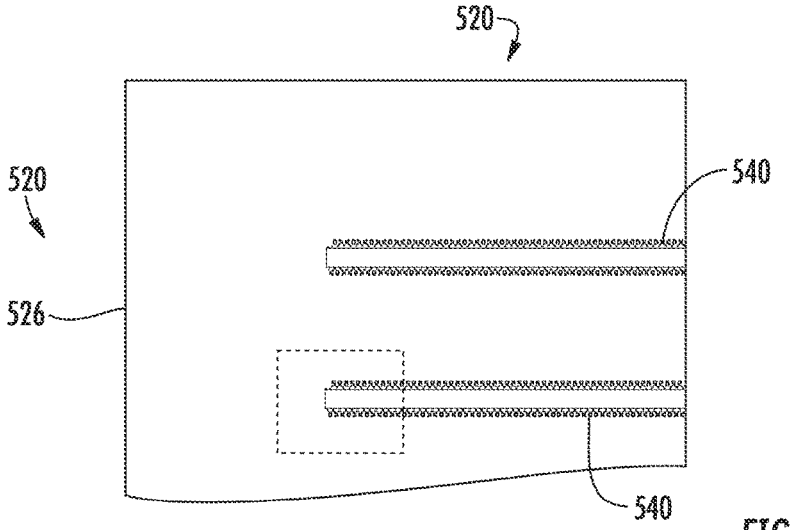
FIG. 8 is an enlarged view of a portion of the printing system of FIG. 7.
Figure 9:
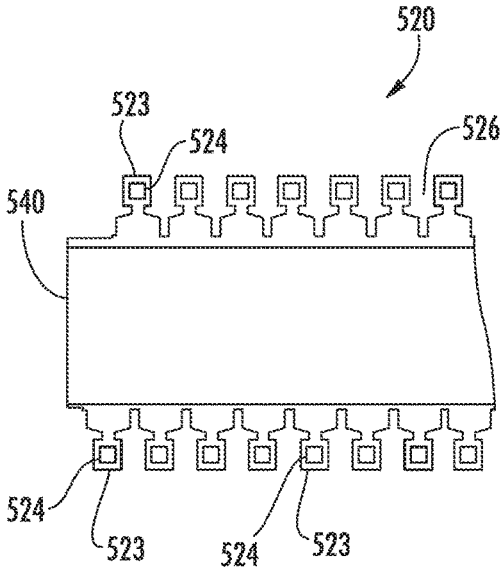
FIG. 9 is an enlarged fragmentary view of a portion of the printing system of FIG. 8

FIGS. 7-10 illustrate printing system 520, another example of printing system 20. Printing system 520 is one example of printing system 420. FIG. 7 illustrates an example silicon die 526 comprising four ink slots 540. FIG. 8 is view of a portion of the die 526 of FIG. 7. FIG. 9 is an enlarged view of a portion of one of ink slots 540 of FIG. 8. As shown by FIG. 9, printing system 520 comprises a row firing chambers 523 on each side of slot 540, wherein the firing chambers 523 of the rows are staggered relative to one another. As further shown by FIG. 9, each firing chamber 523 comprises a thermal fluid droplet ejection drop ejection resister 524 opposite to a corresponding nozzle 28 (shown in FIG. 5).

Figure 10:
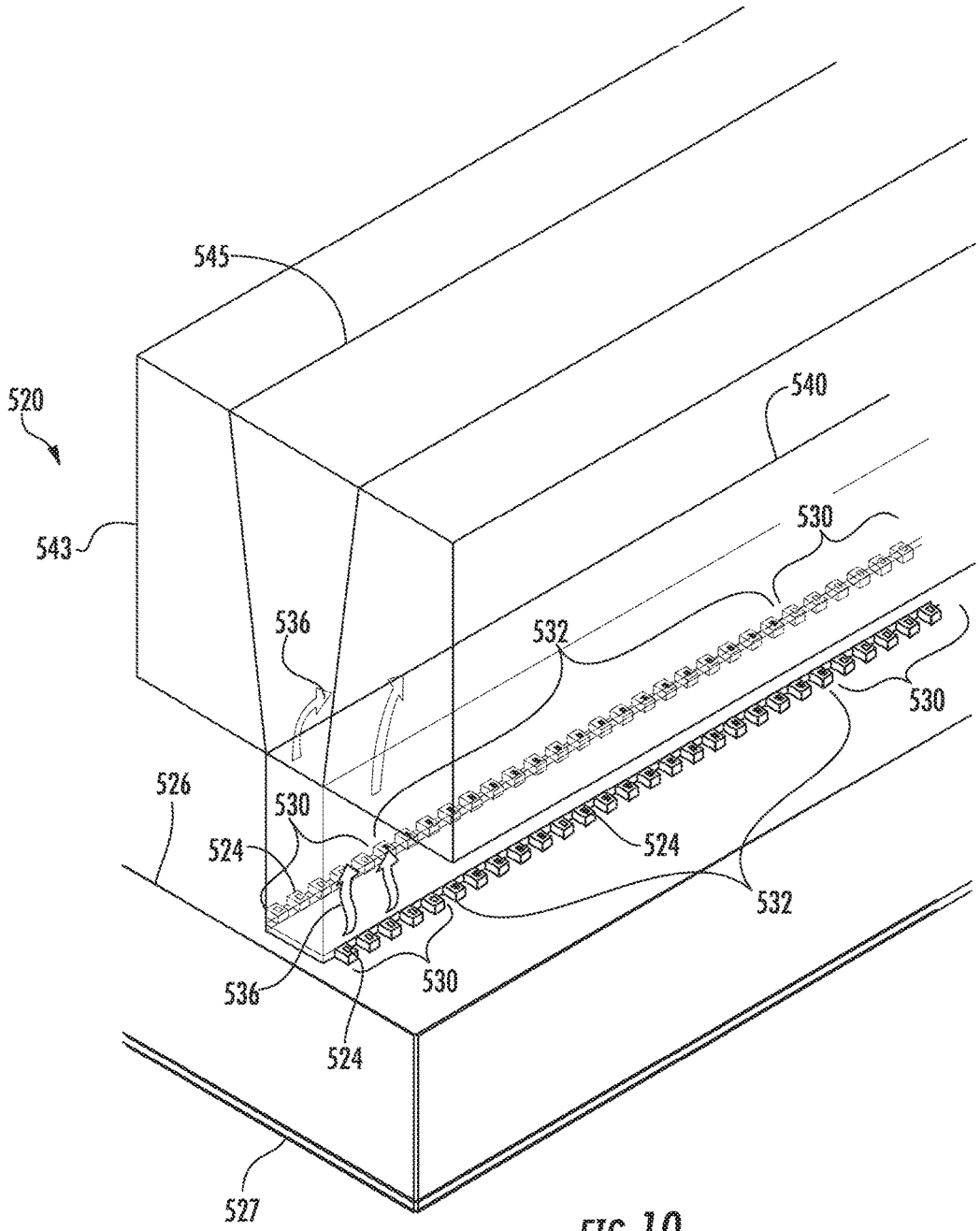
FIG. 10 is a perspective view of the printing system of FIGS. 7-9.

FIG. 10 is a three-dimensional perspective view of the fluid delivery slots shown in FIG. 9 and the fluid supply system, in the form of a plenum 543 having a fluid passage 545 that supplies fluid to the slot 540. FIG. 10 additionally illustrates the nozzle layer 527 in which nozzles 28 are provided for each of resistors 524. As shown by FIG. 10, during a stirring or mixing time period (described above with respect to FIG. 6), end most portions or subsets 530 of the resistors 524 along slot 540 are actuated or pulsed while those remaining, more central, portions or subsets 532 remain dormant or are not fired or pulsed. As described above, the subsets 530 of resistors 524 that are actuated or fired by controller 40 (shown in FIG. 5) or fired with pulses of energy insufficient to heat the adjacent fluid to temperature above the critical temperature of the fluid. Each individual pulse is insufficient to heat the adjacent fluid to a temperature above its nucleation temperature threshold such that bubbles are not formed. At the same time, the frequency of the pulses and the number of the pulses of the subsets 530 of resistors 524 are sufficient to elevate the temperature adjacent to subsets 530 above the temperature of the fluid adjacent to subsets 532 of resistors 524. As schematically represented by arrows 536, the temperature gradient between portions 530 and 532 is sufficient to cause convective stirring or mixing which reduces concentration gradients within slot 540 as well as concentration gradients above and beyond slot 540, within fluid passage 545 of plenum 543.

In one implementation, the frequency of the pulses and the number the pulses of subsets 530 in resistors 524 are sufficient to create temperature gradients of at least 20° C. and nominally between 30° and 40° C. In one implementation, such temperature gradients extend at least 10 mm along slot 540 and at least one millimeter upwardly beyond slot 540 into fluid passage 545. In one implementation, the temperature gradients facilitate fluid velocities of at least 1 to 2 mm/s.

Although printing system 520 is illustrated as having end most subsets of resistors 524 along slot 540 being actuated to heat adjacent fluid to temperatures above the temperatures of the fluid within other portions of slot 540, in other implementations, other subsets a resistors 524 may be actuated to heat adjacent fluid while other subsets of resistors 524 along slot 540 are not actuated or are actuated at a lesser frequency or lower amplitude to facilitate the formation of temperature gradients within the fluid along slot 540.

Figure 11:
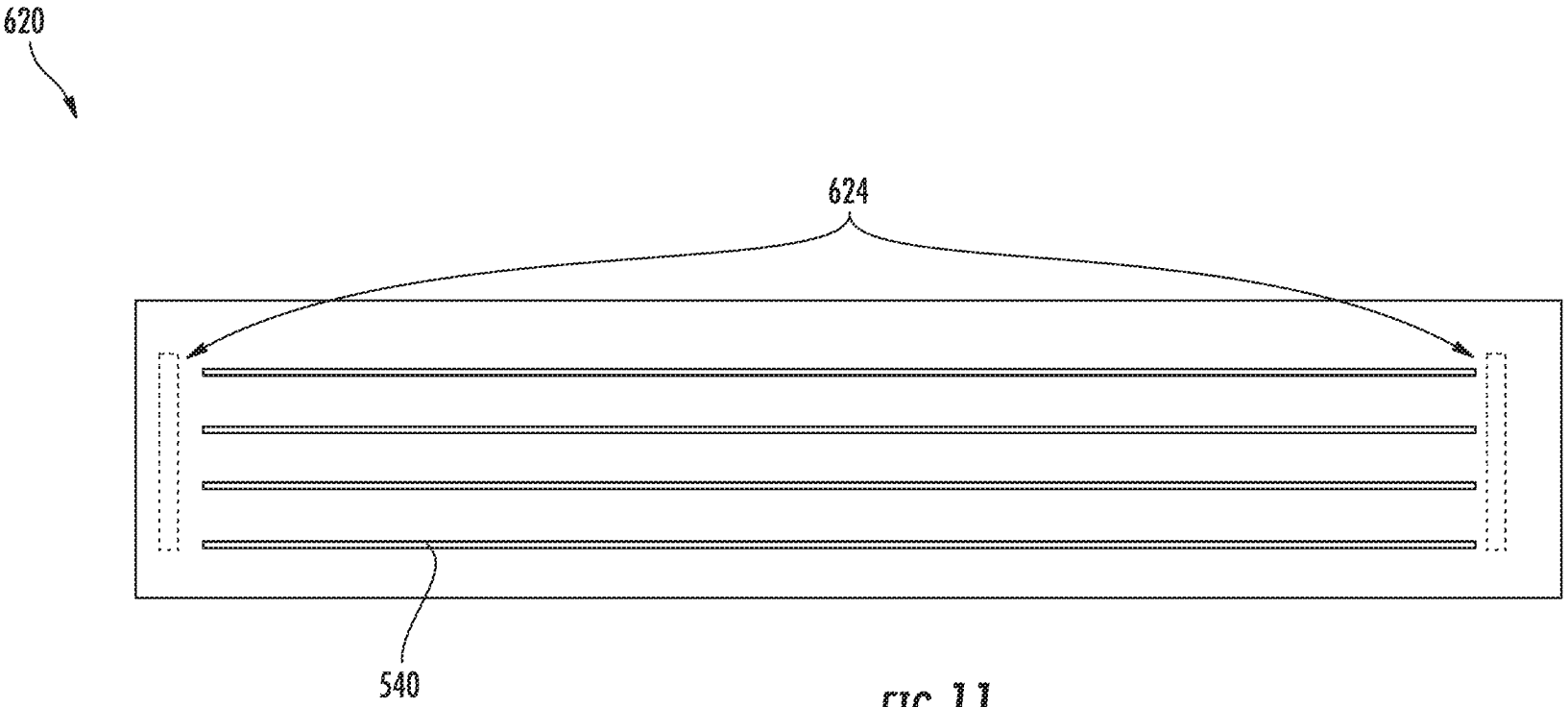
FIG. 11 is a schematic diagram of another example printing system.

FIG. 11 illustrates printing system 620, another implementation of printing system 20. Printing system 620 is similar to printing system 520 described above except that printing system 620 additionally comprises auxiliary heaters 624. Auxiliary heaters 624 are located at and along opposite ends of slots 540. In one implementation, each of such auxiliary heaters 624 comprises a bar of electrically resistive material which generates heat in response to the flow of electric current through the electrically resistive material. In other implementations, each of auxiliary heaters 624 comprise other heating elements or components.

In one implementation, during stirring or mixing time periods, controller 40 (shown in FIG. 5) outputs control signals additionally actuating one or both of auxiliary heaters 624, in addition to the actuation of the end most subsets 530 of resistors 524 shown in FIG. 10. The additional heat generated by auxiliary unit 624 may facilitate larger temperature gradients for enhanced convective stirring or mixing. In other implementations, controller 40 may initiate convective stirring or mixing a fluid within slot 40 using auxiliary heaters 624, alone. In such an implementation, auxiliary heaters heat the fluid within slots 540 to an elevated temperature greater than the temperature of more central portions of slots 540 so as to create temperature gradients that facilitate convective stirring or mixing within each of slots 540. In some implementations, because printing system 620 is able to carry out convective stirring or mixing without necessarily using resistors 524 themselves, resistors 524 may be used for printing while the fluid within a slot 540 or more than one slot 540 is concurrently convectively stirred or mixed by auxiliary heaters 624. As a result, even while printing system 620 is printing, controller 40 may concurrently carry out convective stirring or mixing.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. An apparatus comprising:

a print head body having a slot to receive fluid from a fluid source;

a series of nozzles along the slot;

a heating device proximate to the slot; and a controller to actuate the heating device to heat fluid so as to produce convection flow within and along the slot, wherein the heating device heats the fluid so as to produce convection flow along the slot without forming bubbles in the fluid.

2. The apparatus of claim 1, wherein the heating device heats the fluid adjacent the heating device to a maximum temperature of less than a critical point for water.

3. The apparatus of claim 1, wherein the heating device heats the fluid adjacent the heating device such that the fluid adjacent the heating device has an average temperature over at least one second of between 30° C. and 80° C.

4. The apparatus of claim 1, wherein the heating device comprises an electrical resistor, wherein the electrical resistor is pulsed to heat adjacent fluid to a maximum temperature of less than a critical point for water.

5. The apparatus of claim 1, wherein the heating device comprises a firing chamber along the slot and a thermal fluid droplet ejection firing resistor adjacent the firing chamber to selectively eject fluid through one of the nozzles, wherein the thermal fluid droplet ejection firing resistor serves as the heating device.

6. The apparatus of claim 1, wherein the heating device comprises firing chambers along the slot and thermal fluid droplet ejection firing resistors adjacent the firing chambers to selectively eject fluid through associated ones of the nozzles, wherein a subset of the thermal fluid droplet ejection firing resistors proximate an end of the slot serve as the heating device.

7. The apparatus of claim 1, wherein the heating device heats the fluid so as to produce convection flow having a length of at least one millimeter along the slot.

8. The apparatus of claim 1 further comprising the fluid source, wherein fluid supplied by the fluid source contains pigments.

9. The apparatus of claim 1, wherein the controller is to actuate the heating device to produce convection flow within and along the slot to initiate stirring of fluid within the slot and wherein the controller is to initiate stirring of the fluid within the slot based on at least one criteria selected from a group of criteria consisting of: a stirring command input by user; a lapse of time since a prior stirring of the fluid; a lapse of time since ejection of fluid by any nozzle of the series of nozzles; a sensed degree of settling within the slot; and a sensed concentration gradient within the slot.

10. The apparatus of claim 1, wherein the controller is to actuate heating device to heat the fluid so as to produce a convection flow within and along the slot of at least 0.05 mm/s.

11. The apparatus of claim 1, wherein the controller is to actuate the heating device to heat the fluid so as to produce a temperature gradient of at least 0.1 degC./mm for a period of time at least one second.

12. The apparatus of claim 1, wherein the controller is to actuate the heating device to produce convection flow within and along the slot to initiate stirring of fluid within the slot and wherein the controller is to carry out different stirrings of the fluid within the slot at different times, the different stirrings having different durations of time determined by the controller based on at least one criteria selected from a group of criteria consisting of: a user input duration of time; a lapse of time since a prior stirring of the fluid; a lapse of time since ejection of fluid by any nozzle of the series of nozzles; a sensed degree of settling within the slot; and a sensed concentration gradient within the slot.

13. The apparatus of claim 1, wherein the controller is to actuate the heating device to produce convection flow within and along the slot to initiate stirring of fluid within the slot and wherein the controller is to carry out different stirrings of the fluid within the slot with different temperature gradients at different times, the different temperature gradients determined by the controller based on at least one criteria selected from a group of criteria consisting of: a user input temperature gradient; a lapse of time since a prior stirring of the fluid; a lapse of time since ejection of fluid by any nozzle of the series of nozzles; a sensed degree of settling within the slot; and a sensed concentration gradient within the slot.

14. The apparatus of claim 1, wherein the controller is to actuate the heating device to heat fluid so as to produce convection flow within and along the slot while the print head body is at a docking station.

15. The apparatus of claim 1, wherein the controller is to actuate the heating device to produce convection flow within and along the slot to initiate stirring of fluid within the slot and wherein the controller is track at least one of prior stirring occurrences and prior printing occurrences and wherein the controller is to to initiate stirring of the fluid within the slot based on at least one criteria selected from a group of criteria consisting of: a lapse of time since a prior stirring of the fluid and a lapse of time since a prior printing occurrence.

16. A non-transitory computer-readable medium comprising instructions to direct a processing unit to:

selectively actuate a heating device along a slot of a print head to form temperature gradients within fluid along the slot to facilitate convective fluid flow within and along the slot to initiate stirring of fluid within the slot, wherein timing of initiation of stirring by the medium is based on at least one criteria selected from a group of criteria consisting of: a lapse of time since a prior stirring of the fluid; a lapse of time since ejection of fluid by any nozzle of the series of nozzles; a sensed degree of settling within the slot and a sensed concentration gradient within the slot.

17. The medium of claim 16, wherein the heating device selectively actuated by the processing unit comprises a thermal fluid droplet ejection firing resistor that is also used, at other times, to eject fluid through a nozzle of the print head.

18. The medium of claim 16, wherein the heating device is selectively actuated to heat the fluid adjacent the heating device to a maximum temperature of less than a critical point for water.

19. A method comprising:

ejecting fluid through a nozzle of a print head with an ejection device supplied fluid from a slot; and forming temperature gradients in the fluid along the slot to promote convective stirring of the fluid within and along the slot, wherein the temperature gradients in the fluid along the slot facilitate convection flow upwardly beyond the slot by least 1 mm.

20. The method of claim 19 further comprising using the ejection device to heat the fluid within the slot to form the temperature gradients without producing bubbles in the fluid.

* * * * *